US008076940B2

(12) United States Patent
Martin et al.

(10) Patent No.: US 8,076,940 B2
(45) Date of Patent: Dec. 13, 2011

(54) METHOD AND DEVICE FOR DETERMINING THE LOCATION OF A ROD FIXING POINT

(76) Inventors: Jean-Pierre Martin, Le Vaudreuil (FR); Phillippe Broun, Saint-Egreve (FR); Jean-Paul D. Bongiraud, Varces Allieres et Risset (FR); Vincent Bongiraud, legal representative, Le Villard (FR); Jean-Louis Coulomb, Saint-Ismier (FR)

( * ) Notice: Subject to any disclaimer, the term of this patent is extended or adjusted under 35 U.S.C. 154(b) by 156 days.

(21) Appl. No.: 12/367,622

(22) Filed: Feb. 9, 2009

(65) Prior Publication Data

US 2010/0181994 A1 Jul. 22, 2010

Related U.S. Application Data

(63) Continuation of application No. 12/197,664, filed on Aug. 25, 2008, now abandoned, which is a continuation of application No. PCT/FR2007/050851, filed on Feb. 27, 2007.

(51) Int. Cl.
*G01B 7/14* (2006.01)
*G01V 3/08* (2006.01)

(52) U.S. Cl. ..... 324/345; 324/209

(58) Field of Classification Search ..... 324/207.11, 324/244, 220–221, 345, 209
See application file for complete search history.

(56) References Cited

U.S. PATENT DOCUMENTS

| | | | |
|---|---|---|---|
| 2,897,438 | A | 7/1959 | Fearon |
| 3,233,170 | A | 2/1966 | Rogers |
| 3,639,861 | A | 2/1972 | Russen |
| 4,766,764 | A | 8/1988 | Trevillion |
| 2010/0018306 | A1 | 1/2010 | Martin et al. |

FOREIGN PATENT DOCUMENTS

| | | | |
|---|---|---|---|
| EP | 196829 | A2 | 10/1986 |
| GB | 850733 | A | 10/1960 |
| GB | 2158245 | A | 11/1985 |
| JP | 55101044 | A | 8/1980 |

OTHER PUBLICATIONS

"U.S. Appl. No. 12/436,006, Non-Final Office Action mailed Jul. 22, 2010", 5 pgs.
"U.S. Appl. No. 12/436,006, Notice of Allowance mailed Mar. 8, 2011", 8 pgs.
"U.S. Appl. No. 12/436,006, Preliminary Amendment filed May, 5, 2009", 4 pgs.
"U.S. Appl. No. 12/436,006, Response flied Jan. 24, 2011 to Non Final Office Action mailed Jul. 22, 2010", 12 pgs.

(Continued)

*Primary Examiner* — Reena Aurora
(74) *Attorney, Agent, or Firm* — Schwegman, Lundberg & Woessner, P.A.

(57) ABSTRACT

The invention concerns the methods for determining, relative to a point Po, the location of a fixing point Pf of a rod T located in an environment Mi wherein prevails a permanent magnetic field Ch. The inventive method is characterized in that it consists in studying the variations of the magnetic flux which passes through the windows F when the rod is and is not subjected to a torque about its axis A, said windows having substantially the same area and being connected to the rod T respectively in different points Px, Px+1, . . . located on the portion of the rod delimited by the assumed site of the fixing point Pf, and including the point Po, and having each a given position relative to the magnetic field lines of force when the rod is not subjected to the torque. The invention also concerns a device for implementing said method. The invention is advantageously applicable to determining the location of the sticking point of a string of hollow drill rods in an oil well.

20 Claims, 2 Drawing Sheets

OTHER PUBLICATIONS

Figure 1:
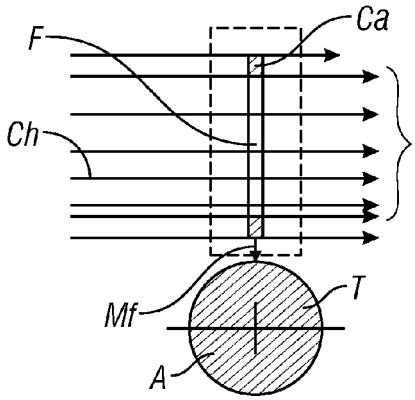

"International Application Serial No. PCT/FR2007/050851, International Preliminary Report on Patentability issued Sep. 9, 2008", (w/ English Translation), 10 pgs.

"International Application Serial No. PCT/FR2007/050851, International Search Report mailed Jul. 6, 2007", 4 pgs.

"International Application Serial No. PCT/FR2007/050851, Written Opinion mailed Jul. 6, 2007", (w/ English Translation), 9 pgs.

"International Application Serial No. PCT/FR2007/051153, International Preliminary Report on Patentability dated Apr. 21, 2006", (w/ English Translation), 12 pgs.

"International Application Serial No. PCT/FR2007/051153, International Search Report mailed Sep. 24, 2007", 2 pgs.

"International Application Serial No. PCT/FR2007/051153, Written Opinion mailed Sep. 24, 2007", (w/ English Translation), 10 pgs.

METHOD AND DEVICE FOR DETERMINING THE LOCATION OF A ROD FIXING POINT

RELATED APPLICATIONS

This application is a continuation of U.S. patent application Ser. No. 12/197,664, filed Aug. 25, 2008 now abandoned, which is a continuation under 35 U.S.C. 111(a) of International Application No. PCT/FR2007/050851, filed Feb. 27, 2007 and published as WO 2007/096567 A1, on Aug. 30, 2007, which claimed priority under 35 U.S.C. 119 to French Patent Application Serial No. 0601667, filed Feb. 27, 2006, which applications and publication are incorporated herein by reference in their entirety and made a part hereof.

The present invention concerns the methods and devices for determining the location of the point of fixation of a rod in an environment where a permanent magnetic field prevails, such as the earth's magnetic field, and, by way of application, the methods and devices for determining the location of the sticking point of a string of rods used to drill an oil well or the like in the ground.

As is known, to drill an oil well, for example, one uses a hollow boring rod made up of an assemblage of pieces of successive rods, known as a "string of rods", whose penetrating end contains means of boring. These boring devices are well known in themselves, as is their use, and they shall not be further described here.

More particularly, in the oil well field, these strings of rods may reach very long lengths, several thousands of meters, and they are sometimes subjected to seizing, which prevents further drilling of the well or their return to the surface. Such seizing may occur, for example, after encountering an obstacle, a landslide, etc.

Granted that such a seizing generally occurs at a great depth, it is obviously impossible to abandon the entire string of rods and boring bits, as well as the portion of well already achieved.

It is thus absolutely essential to unwedge the string of rods to recover the totality of the drilling elements and continue drilling the well.

For this, various techniques have been created and can be carried out, as long as the location of the jam has been determined with a relatively good precision.

In the case of drilling an oil well by means of a string of boring rods screwed end to end, one must determine the ends of the pieces of rod situated on either side of the jam.

To determine the position of the sticking point, use has already been made of a tool which is introduced inside the string of rods, lowered down to the bottom of the well, then brought back up step by step, that is, rod by rod, making specific measurements at each step.

Without going into the details, such a tool is generally made of two heads coupled to each other and separated from each other by a gap bounded by two parallel planes in an oblique direction relative to the axis of the hollow rod when the tool is arranged in the string of rods, stipulating that the two heads are provided with elements for fixing them, during each step, against the inner wall of the string of rods, and holding them at two lines of fixation, separated by a distance less than the length of one piece of rod forming the string of rods, the gap being situated between these two lines of fixation.

It is well known that the drilling operator can find out the approximate position of the sticking point relative to the well summit, but not with enough precision to intervene in optimal manner and release the jammed string of rods. In fact, by applying a traction of a known value to the end of the string of rods emerging from the summit of the well and measuring the resulting elongation, since he knows the coefficient of elongation of the pieces of rods, he can estimate the location of the sticking point, but cannot determine it in precise manner.

To determine the location of the sticking point of the string of rods in the well with more precision, the operator lowers the tool defined above inside the string of rods, for example, by means of a cable or the like, than positions it at a first location which is definitely at a level below that of the sticking point, determined as mentioned above. The position of the tool from the summit of the well is known with precision, notably by the length of cable paid out. The two heads are thus fixed against the inner wall of the string of rods, and the operator then carries out two maneuvers. One of these maneuvers involves exerting a traction to the end of the string of rods emerging from the well, the other involves exerting a twist to this same end. During each of these maneuvers, the variations in the gap are measured in known fashion.

These maneuvers and measurements are done at each stage of raising the tool back up, step by step, until the tool is aligned with a level where it is definitely situated above the sticking point of the string of rods in the well.

The measuring of the variation of the gap can be done, for example, by means of two coils, one emitting, the other receiving, the latter furnishing an output signal which is a function, on the one hand, of the signal applied to the emitting coil, and on the other hand the width of the gap.

If a traction is exerted on the string of rods, it will undergo an elongation solely on the length situated above the sticking point and, since the tool is situated in the well such that the two lines of fixation of its two heads are below the sticking point, the width of the gap will not undergo any modification. The signal emitted by the receiving coil will be constant and equal to a first value. Once the tool passes the sticking point, the elongation of the string of rods is applied between the two lines of fixation of the two heads and produces a modification in the width of the gap. The signal emitted by the receiving coil takes on a value different from the first.

The same is true when one exerts a twisting to the string of rods. As the tool is located below the sticking point, the two heads will not pivot relative to each other and the width of the gap thus remains at its nominal value. Once the tool passes the sticking point, the two heads will pivot relative to each other and, since the gap has an oblique direction relative to the axis of the rods, its width will undergo a modification, as will the signal emitted by the receiving coil.

By studying the totality of these measurements at each step of the movement of the tool, it is possible to determine with good precision, as a function of the movement step of the tool, the location of the sticking point of the string of rods in the well, as well as the nature of this sticking, whether in rotation, or in traction, or in traction and rotation at the same time.

It is then possible, by a technique familiar in itself, to unscrew the string of rods at the level of the screw collar located just above the level of the sticking point, to recover the portion of the string of rods thus liberated, to lower a special tool to recover the rest of the string of rods and the drill bit, and even to eliminate the cause of the sticking.

From the above description, it is evident that the method is relatively long in duration and therefore causes a large increase in the cost of drilling a will. Moreover, the difficulty of its implementation limits the reliability of the results.

Other methods have also been implemented, for example, those described in EP-A-196 829 and U.S. Pat. No. 4,766,764.

The method described in the first cited document consists basically in lowering, step by step along the string of rods, a first tool which produces magnetic field pulses, creating magnetic markers in the rods in incremental fashion, lowering a second tool to make a measurement of the first magnetic field value of all the markers applied by the first tool, subjecting the string of rods to mechanical stresses, and finally determining the markers whose magnetic field value has undergone a variation with respect to the first value. The location of two adjacent magnetic markers, one having a magnetic field variation and the other one not, determines the position of the jam of the string of rods between them.

As for the second method, it involves subjecting the string of rods to a twisting after having applied magnetic markers to it, then making a measurement of the magnetic field of these markers along a generatrix of the rod prior to its twisting, and locating the first marker which is away from this generatrix, by the fact that its distance causes a decrease in its magnetic field. The location of this marker defines the position of the sticking point.

As for the method of GB-A-2 158 245, it requires a stage of magnetic excitation of the string of rods and two additional stages involving the making of two measurements before and after having subjected the string of rods to a mechanical stress, then a comparison of the results of the two measurements to determine the sticking point.

These prior methods are relatively long and also difficult to carry out, and sometimes they are not very reliable. Moreover, of course, they can only be carried out if the rods are made of a ferromagnetic material.

Thus, the purpose of the invention is to implement a method for determining the location of the fixation point of a rod in an environment where a permanent magnetic field is prevailing, notably the earth's magnetic field, which can remedy in large measure the inconveniences mentioned above for the techniques used up to the present, that is, a method allowing one to determine with precision the location of this fixation point more quickly and easily than with the methods of the prior art, and this regardless of the nature of the rod, and one which is applicable to well drilling rods for extraction of hydrocarbons such as petroleum, gas, or the like.

Another purpose of the present invention is to create a device allowing the method of the invention to be implemented.

More precisely, the purpose of the present invention is a method for determining, with regard to an origin point, the location of a fixation point of a rod situated in an environment where a permanent magnetic field is prevailing, when the presumed location of said fixation point has been estimated beforehand, characterized in that it involves studying the variations in the magnetic flux passing through windows when said rod is and is not subjected to a torque about its axis, said windows having basically the same area and being connected to the rod respectively at different points situated on the portion of rod bounded by the presumed location of the fixation point and including the origin point, each one having a position determined with respect to the lines of force of the magnetic field when the rod is not subjected to the torque.

Another purpose of the present invention is a device able to implement the method as defined above, to determine, with regard to an origin point, the location of a fixation point of a rod situated in an environment where a permanent magnetic field is prevailing, characterized in that it comprises a sensor including at least one window able to have said magnetic field pass through it, said sensor being able to produce signals depending on the magnetic flux passing through said window, means of connecting said sensor to the portion of rod and disconnecting it so that it can be positioned at different points of said portion of rod, and means of processing the signals put out by said sensor.

Figure 4:
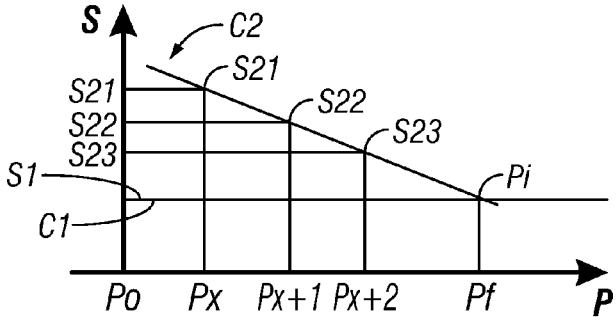
Figure 5:
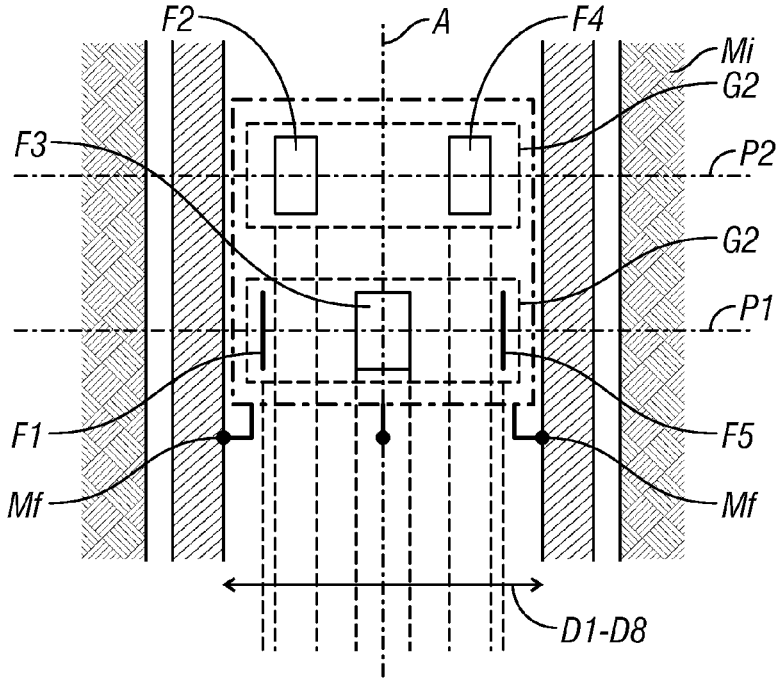
Figure 6:
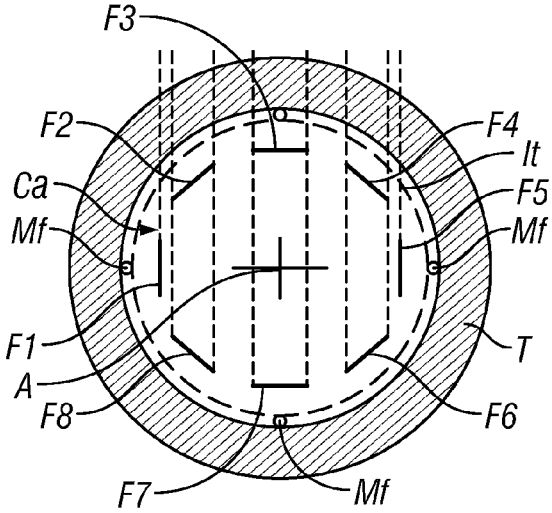
Figure 7:
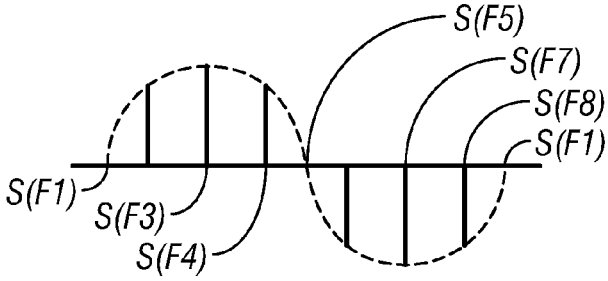

Other characteristics and advantages of the present invention will appear in the course of the following description, given with regard to the enclosed drawings as an illustration, but by no means a limitation, where:

FIGS. 1 to 4 represent four diagrams explaining the implementing of the method of the invention to determine, with regard to an origin point Po, the location of a fixation point Pf of a rod T situated in an environment Mi where a permanent magnetic field Ch is prevailing, FIGS. 5 and 6 show, schematically, a longitudinal section and a cross section of one embodiment of the device per the invention to carry out the method of the invention, and FIG. 7 shows a curve to explain the results which can be obtained with the embodiment of the device of the invention, illustrated more particularly in FIGS. 5 and 6.

First of all, it is stipulated that the figures show only one embodiment of the device of the invention, but there can be other embodiments falling within the definition of this invention.

Moreover, it is stipulated that when in the definition of the invention the object of the invention contains "at least one" element having a given function, the embodiment described may contain several of these elements. By the same token, if the embodiment of the object of the invention as illustrated contains several elements of identical function and if the description does not specify whether the object under this invention should necessarily contain a particular number of these elements, the object of the invention could be defined as having "at least one" of these elements.

Finally, it is stipulated that when in the present description an expression defines by itself, without any specific mention concerning it, a set of structural characteristics, these characteristics can be used either separately or in total and/or partial combination, whenever technically possible, for the definition of the object being patented.

Making reference more particularly to FIGS. 1 to 4, the invention concerns a method for determining, with regard to an origin point Po, the location of a fixation point Pf of a rod T of any material whatsoever, situated in an environment Mi where a permanent magnetic field Ch is prevailing, when the presumed location of said fixation point has been estimated beforehand, for example, as succinctly summarized in the preamble. In the most common and preferred applications of this method, this permanent magnetic field Ch will be the earth's magnetic field.

The method is characterized basically by the fact that involves studying the variations in the magnetic field Ch flux passing through windows F when the rod is and is not subjected to a torque about its axis A. These windows are connected to the rod T respectively at different points Px, Px+1, etc. situated on the portion of rod bounded by the presumed location of the fixation point Pf and including the origin point Po. They all have basically the same area and each one has a position, preferably identical, which is determined with respect to the lines of force of the magnetic field Ch when the rod T is not subjected to the torque.

According to one advantageous embodiment, the method consists in determining the strength S1 of a first signal, FIG. 4, representing the flux of the magnetic field passing through at least one window F when the rod is not subjected to the twisting, FIG. 1.

Figure 2:
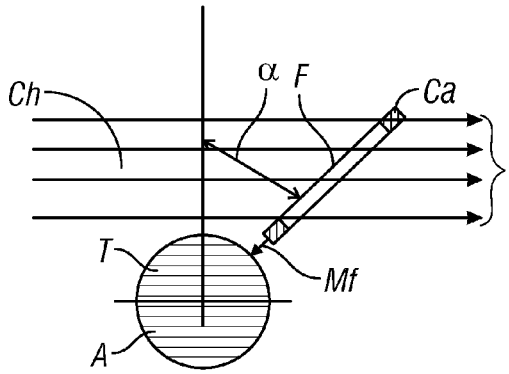
Figure 3:
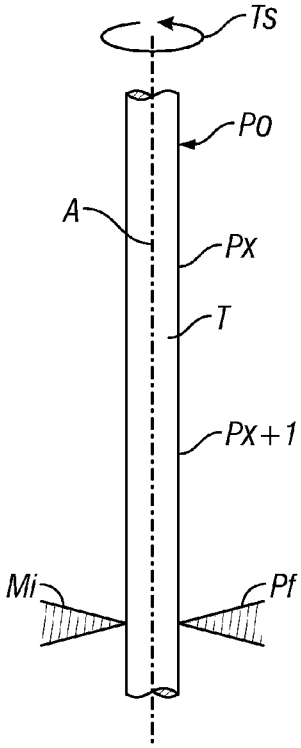

It then involves determining, when the rod is subjected to the twisting, FIG. 2, the strengths S21, S22, etc., of at least two second and third signals depending on the flux of the magnetic field passing through two windows F situated at two points PX, Px+1, not merging, indexed on the portion of rod with respect to the origin point Po, then determining the point of intersection Pi of the two curves C1, C2 (FIG. 4) representing, respectively, the strength S1 of the first signal and the strengths S21, S22, etc., of the second and third signals as a function of the indexing of the points of connection of the windows to the portion of rod, this point of intersection Pi of the two curves defining the indexing of the fixation point Pf of the rod T, that is, the distance separating the origin point Po and this fixation point Pf.

In fact, if one considers first of all the rod T not subjected to the twisting and a window F connected to this rod essentially perpendicular to the lines of force of the magnetic field Ch (FIG. 1), the flux of this magnetic field through the window of area Sa is equal to Bo.Sa, where Bo is the value of the magnetic induction of the magnetic field Ch, and the strength S1 of the first signal is given by the following function of formula: S1=f(Bo.Sa).

The strength S1 of the first signal is represented by the curve C1 in FIG. 4 which shows, along the ordinate axis: the strength S of the signals representing the flux of the magnetic field Ch through the windows F and, on the abscissa axis: the distance P separating the origin point Po and the points Px, Px+1, Px+2 of connection of the windows to the portion of rod.

It should be noted that the strength of the signal representing the magnetic flux through a window will be the same for all the windows having the same position relative to the lines of force of the magnetic field Ch, since the length of the rod is negligible with respect to the diameter of the earth and the magnetic field Ch is uniform.

Keeping the above in mind, it is clear that the curve C1 is parallel to the abscissa axis, since the strength S1 is constant.

Now, if one considers two windows F connected to the rod T at two different points Px and Px+1 on the portion of rod (FIG. 3) in the same position with respect to the lines of force of the magnetic field Ch as in FIG. 1, and if one subjects the rod to a twisting Ts around its axis A, for example, by acting at the level of the point Po, one obtains a "curling" of the portion of rod starting from the fixation point Pf, which is fixed, the amplitude of the curl increasing as one moves away from this fixation point.

As a first consequence, the windows are driven in rotation about the axis A by the rod T, and are no longer perpendicular to the magnetic field Ch (FIG. 2). The flux of the magnetic field through a window is then equal to Bo.Sa.cos$\alpha$, where $\alpha$ is the value of the angle of rotation of the window.

Moreover, one of the two windows undergoes a more considerable rotation than the other. More precisely, the one which undergoes the more substantial rotation is the one that is more distant from the fixation point Pf, that is, the one closer to the point Po, where the torque is applied.

The flux of the magnetic field Ch through a window F thus varies as a function of the distance between the origin point Po and the point of connection Px, Px+1, Px+2, etc., of the window to the portion of rod T, which translates into a variation in the strength S21, S22, S23, etc., of the signal representing this magnetic flux.

Generally speaking, for a rod of uniform cross section and made of the same material for its entire length, the increase in the amplitude of curling is basically linear. Thus, it will be enough to take only two measurements at two different points Px, Px+1. But, advantageously, more than two will be taken (FIG. 4).

The values S21, S22, S23, etc., of the signals representing the flux of the magnetic field Ch through the windows respectively connected to the rod at the points Px, Px+1, Px+2 that are indexed relative to the origin point Po are shown in the same reference system as the preceding curve C1. One obtains the curve C2. The point of intersection of the two curves C1 and C2 lets one determine the indexing of the fixation point Pf, that is, the distance separating the origin point Po and this fixation point Pf, since it is the point which has not undergone any curling.

Since the signal S1 is constant, it is quite evident that a curve C1 equivalent to the one shown in FIG. 4 can be obtained by subtracting the value S1 from each value S21, S22, S23, etc. The curve C1 thus merges with the abscissa axis P of the reference system and the two points Pi and Pf are merged with this abscissa axis P.

The description of the implementation of the method of the invention has been given above in the case when all the windows F have the same position with respect to the lines of force of the magnetic field Ch when the rod T is not subjected to the torque.

However, the method of the invention can also be implemented when the windows have different orientations with regard to the lines of force of the magnetic field when the rod is not subjected to the twisting, within the given limits, of course.

In fact, in this case, when the rod is not subjected to the force of twisting, one obtains different values of signals S11, S12, S13, etc., produced by the windows F connected to the portion of rod respectively at points Px, Px+1, Px+2, etc., and these windows will induce, after twisting of the rod T, signals respectively with values S'21, S'22, S'23, etc.

In this case, the values S21, S22, S23, etc., defined above and used to define the curve C2 (FIG. 4), will be respectively equal to the following values: S21=S'21−S11; S22=S'22−S12 and S23=S'23−S13, etc.

This so-called method of "differential measurements" to implement the method of the invention is equivalent to that described in the first place, when the same value S1 has been subtracted from each value S21, S22, S23.

It should be noted that this method can be implemented regardless of the nature of the material of the rod T, and whether this rod is solid (FIGS. 1 to 3) or hollow, as shall be described with regard to FIGS. 5 and 6. In the case when the rod is hollow, it can be advantageous for the windows F to be connected directly to its inside It.

The present invention also concerns a device to implement the above defined method, to determine with regard to an origin point Po the location of a fixation point Pf of a rod T situated in an environment Mi where a permanent magnetic field Ch is prevailing.

This device comprises at least one sensor Ca including at least one window F able to have the magnetic field Ch pass through it, said sensor being able to produce signals S1, S21-S22-S23 depending on the flux of the magnetic field passing through the window F, means Mf of connecting the sensor Ca to the portion of rod and disconnecting it so that it can be positioned at different points of this portion of rod, and means of processing the signals put out by the sensor.

A window of a sensor Ca, for example, can be comprised of a coil of electrically conducting wire, but advantageously such a sensor can be made from the sensor known by the commercial name "Honeywell Single-axis Magnetic Sensor HMC 1021D".

The means of processing the signals put out by the sensor Ca will not be described more fully here, since they are well known in themselves. They can be manual or, preferably, of the microprocessor type, able to operate by means of a program which will not be difficult to develop by the practitioner who is familiar, in particular, with the description of the implementation of the method given above.

According to one preferred embodiment, the sensor Ca has a plurality of windows F1, F2, F3, F4, etc., FIGS. 5 and 6, having different angular positions relative to each other in order to be able to process several signals of different strength, FIG. 7, so as to obtain a very precise result, and increase the sensitivity of the sensor by reducing to the utmost the signal to noise ratio according to the method well known to practitioners in this type of measurement by the English term of "stacking", which can be translated as a "method of addition of signals".

Advantageously, the sensor contains at least one group G1 or G2 of four windows F1-F3-F5-F7, F2-F4-F6-F8 basically situated at the four corners of a square. Preferably, these four windows will be tangent to a circle whose center coincides with the center of the square.

It is even possible, for applications such as will be mentioned afterwards, and to obtain a maximum number of usable signals, for the sensor Ca to have two groups G1, G2, each of four windows F1, . . . , F8, the two groups G1, G2 being situated respectively in two basically parallel planes P1, P2 (FIG. 5), being perpendicular to the axis A of the rod T.

To obtain the greatest possible signal strengths regardless of the position of the sensor with regard to the rod T, these eight windows F1, . . . , F8 are basically situated respectively on eight straight lines D1-D8, essentially parallel to the axis A of the rod and passing respectively through the vertices of a regular octagon, FIGS. 5 and 6.

The curve per FIG. 7 represents one example of values of signals produced by the eight windows of a sensor as that described above and illustrated schematically in FIGS. 5 and 6, when it has a given position in relation to the lines of force of the magnetic field Ch.

The signals of maximum strength S(F3) and S(F7) are produced by the windows which are perpendicular to the magnetic field Ch, which in the case of FIGS. 5 and 6 is perpendicular to the plane of FIG. 5. The signals whose strength is zero S(F1), S(F5) are to be associated with the windows which are parallel to the lines of force of this same magnetic field Ch, since no field line passes through these windows.

As mentioned above, the device can find applications regardless of the shape of the rod or the nature of the material from which it is made.

However, when the rod T is hollow, the means Mi for connecting the sensor Ca to the rod T and disconnecting it can advantageously be arranged to secure the sensor to the inside It of the rod T, as is necessary when the device finds an application in determining a fixation point of a boring rod for a well in the ground to extract hydrocarbons when this fixation point constitutes a sticking point of the boring rod in the well.

These means of connecting Mf the sensor to the rod can be of any type, in particular like those which make it possible to fix the measuring tools that one uses in the boring rods of oil wells or the like. These means, well known in themselves, are generally made up of legs arranged on the sensor which move apart to attach to the inner wall of hollow boring rods.

The operation of the device described above is deduced with no difficulty from the description of the method defined and explained above.

However, it is stipulated that one generally uses only a single sensor Ca, and that this sensor is moved in relation to the rod to different indexed points Px, Px+1, etc., to take at these points the measurements described above, in order to determine the strength of the signal emitted by the sensor.

It is assumed, from the start, that the sensor having only a single window F is connected to the rod not subjected to the torque, for example, at Px, and the first measurement is taken with result S1. The rod is then subjected to the torque, and a second measurement is taken with result S21. The torque is released and the sensor Ca, disconnected from the rod T, is moved to a second point of the rod T, for example, Px+1, different from Px, and the torque, the same as before, is again applied to the rod. A third measurement with result S22 is then taken. And so on for each point Px+2, etc.

The measurement results are reported, as described above, in the same reference frame S as a function of P (FIG. 4), as defined above, either in manual fashion or more generally with computerized means, to determine the point Pi and thus the point Pf.

It should be noted that, with a sensor having eight windows such as the one described above, it will be possible to superimpose, on the same reference frame (S as a function of P, FIG. 4), eight sets of two curves C1 and C2 each. One thus obtains eight points Pi whose abscissas coincide, or at least are very close together, making it possible to determine statically, with a greater accuracy, the indexing of the fixation point Pf relative to the origin point Po.

However, when such a sensor is lower to great depths, as in the case of the application to determining the sticking point of an oil well boring rod or the like, it is relatively difficult to maintain it such that the windows always have, during the course of the descent, the same orientation with respect to the lines of force of the earth's magnetic field Ch. Consequently, the processing means will be programmed to process the signals by the "differential measurement" method, as defined above.

The invention claimed is:

1. A method to determine a fixation point of a rod in a well, comprising:

while no torque is applied to the rod about a longitudinal axis of the rod, measuring the magnetic flux due to the Earth's magnetic field that passes through a window attached to the rod;

while applying a torque to the rod about the axis, measuring the magnetic flux due to the Earth's magnetic field that passes through the window when attached to the rod at a first location and measuring the magnetic flux due to the Earth's magnetic field that passes through the window when attached to the rod at a second location, wherein the first and second locations are known with respect to a point of origin on the rod; and, determining the fixation point of the rod relative to the point of origin as a function of the measurement of magnetic flux taken when no torque is applied to the rod and a difference between the measurements of the magnetic flux taken at the first and second locations.

2. The method of claim 1 wherein, during measurements of the magnetic flux, the window is attached to the rod at a known orientation with respect to the magnetic field when no torque to applied to the rod and wherein the function is defined by:

plotting the magnetic flux measurements taken at the first and second locations as points in a plane defined by a location axis and a magnetic flux axis;

constructing a first line in the plane that connects the magnetic flux measurements taken at the first and second locations; and defining the fixation point as a location at which the first line intersects with a second line that represents a constant magnetic flux value equal to the magnetic flux measurement taken when no torque is applied to the rod.

3. The method of claim 1 wherein, during measurements of the magnetic flux, the window is attached to the rod at a known orientation with respect to the magnetic field when no torque to applied to the rod and wherein the function is defined by:

modifying the magnetic flux measurements taken at the first and second locations by subtracting from those measurements the magnetic flux measurement taken when no torque is applied to the rod;

plotting the modified magnetic flux measurements taken at the first and second locations together with their respective locations as points in a plane defined by a location axis and a magnetic flux axis;

constructing a line in the plane that connects the modified magnetic flux measurements taken at the first and second locations; and defining the fixation point as a location at which the line intersects with the location axis.

4. The method of claim 1 wherein:

measuring the magnetic flux due to the Earth's magnetic field when no torque is applied to the rod about the axis comprises measuring the magnetic flux at the first and second locations; and, wherein the function is defined by: modifying the magnetic flux measurements taken at the first and second locations when torque is applied to the rod by subtracting from those measurements the magnetic flux measurement taken at the first and second locations, respectively, when no torque is applied to the rod, plotting the modified magnetic flux measurements taken at the first and second locations together with their respective locations as points in a plane defined by a location axis and a magnetic flux axis, constructing a line in a plane that connects the modified magnetic flux measurements, and defining the fixation point as a location at which the line intersects with the location axis.

5. The method of claim 1 wherein the rod is hollow and the magnetic flux measurements are taken with a sensor attached to the inside of the rod, the sensor having one or more windows.

6. The method of claim 5 further comprising attaching the sensor to the inside of the rod with legs that attach to an inner wall of the rod.

7. The method of claim 1 further comprising measuring the magnetic flux at the first and second locations when torque is applied to the rod using a plurality of windows attached with different orientations to obtain multiple determinations of the fixation point.

8. A method to determine a fixation point of a rod in a well, comprising:

while applying a torque to the rod about a longitudinal axis of the rod, measuring the magnetic flux due to the Earth's magnetic field that passes through a first window attached to the rod at a first location and measuring the magnetic flux due to the Earth's magnetic field that passes through a second window attached to the rod at a second location, wherein the first and second locations are known with respect to a point of origin on the rod;

while no torque is applied to the rod about the axis, measuring the magnetic flux due to the Earth's magnetic field that passes through at least one of the first or second windows or a third window attached to the rod at a third location; and, determining the fixation point of the rod relative to the point of origin as a function of the measurement of magnetic flux taken when no torque is applied to the rod and a difference between the measurements of the magnetic flux taken at the first and second locations.

9. The method of claim 8 wherein:

measuring the magnetic flux due to the Earth's magnetic field when no torque is applied to the rod about the axis comprises measuring the magnetic flux through the first and second windows at the first and second locations; and, wherein the function is defined by: modifying the magnetic flux measurements taken at the first and second locations when torque is applied to the rod by subtracting from those measurements the magnetic flux measurement taken at the first and second locations, respectively, when no torque is applied to the rod, plotting the modified magnetic flux measurements taken at the first and second locations together with their respective locations as points in a plane defined by a location axis and a magnetic flux axis, constructing a line in a plane that connects the modified magnetic flux measurements, and defining the fixation point as a location at which the line intersects with the location axis.

10. The method of claim 8 wherein, during measurements of the magnetic flux, the windows are attached to the rod at a known orientation with respect to the magnetic field when no torque to'applied to the rod and wherein the function is defined by:

plotting the magnetic flux measurements taken at the first and second locations as points in a plane defined by a location axis and a magnetic flux axis;

constructing a first line in the plane that connects the magnetic flux measurements taken at the first and second locations; and defining the fixation point as a location at which the first line intersects with a second line that represents a constant magnetic flux value equal to the magnetic flux measurement taken when no torque is applied to the rod.

11. A device, comprising:

a sensor having a window for measuring magnetic flux passing through the window, the sensor being attachable to a rod situated in a well and movable to different locations along the rod; and, a processor programmed to:

receive signals from the sensor to measure the magnetic flux due to the Earth's magnetic field that passes through the window while no torque is applied to the rod about a longitudinal axis of the rod, while a torque is applied to the rod about the axis, receive signals from the sensor to measure the magnetic flux due to the Earth's magnetic field that passes through the window at a first location and at a second location, wherein the first and second locations are known with respect to a point of origin on the rod, and determine a fixation point of the rod relative to the point of origin on the rod as a function of the measurement of magnetic flux taken when no torque is applied to the rod and a difference between the measurements of the magnetic flux taken at the first and second locations.

12. The device of claim 11 wherein the sensor has a plurality of windows with different orientations to one another.

13. The device of claim 12 wherein the sensor has at least one group of four windows generally situated at the four corners of a square.

14. The device of claim 13 wherein the four windows are approximately tangent to a circle whose center coincides with the center of the square.

15. The device of claim 12 wherein the sensor has two groups of four windows each, the two groups being situated respectively in two substantially parallel planes.

16. The device of claim 15 wherein the eight windows are situated respectively on eight straight lines, generally parallel to the longitudinal axis of the rod.

17. The device of claim 11 wherein the sensor is removably attachable to a hollow inner portion of the rod.

18. The device of claim 17 wherein the sensor attaches to an inner wall of the rod.

19. The device of claim 11 wherein the function is defined by:

plotting the magnetic flux measurements taken at the first and second locations as points in a plane defined by a location axis and a magnetic flux axis;

constructing a first line in the plane that connects the magnetic flux measurements taken at the first and second locations; and defining the fixation point as a location at which the first line intersects with a second line that represents a constant magnetic flux value equal to the magnetic flux measurement taken when no torque is applied to the rod.

20. The device of claim 11, wherein:

the processor is programmed to receive signals from the sensor to measure the magnetic flux due to the Earth's magnetic field that passes through the window while no torque is applied to the rod about a longitudinal axis of the rod by measuring the magnetic flux at the first and second locations; and, the function is defined by: modifying the magnetic flux measurements taken at the first and second locations when torque is applied to the rod by subtracting from those measurements the magnetic flux measurement taken at the first and second locations, respectively, when no torque is applied to the rod, plotting the modified magnetic flux measurements taken at the first and second locations together with their respective locations as points in a plane defined by a location axis and a magnetic flux axis, constructing a line in a plane that connects the modified magnetic flux measurements, and defining the fixation point as a location at which the line intersects with the location axis.

* * * * *